US005961811A

United States Patent [19]

Keller

[11] Patent Number: 5,961,811

[45] Date of Patent: Oct. 5, 1999

[54] POTLINING TO ENHANCE CELL PERFORMANCE IN ALUMINUM PRODUCTION

[75] Inventor: Rudolf Keller, Export, Pa.

[73] Assignee: EMEC Consultants, Export, Pa.

[21] Appl. No.: 08/943,024

[22] Filed: Oct. 2, 1997

[51] Int. Cl.[6] ..... C25C 3/08; H01B 1/06

[52] U.S. Cl. ..... 205/386; 204/247.4; 204/247.3; 252/507

[58] Field of Search ..... 204/247.4, 247.3; 252/504, 507, 502; 205/386

[56] References Cited

U.S. PATENT DOCUMENTS

| | | | |
|---|---|---|---|
| 3,028,324 | 4/1962 | Ransley | 204/67 |
| 3,400,061 | 9/1968 | Lewis et al. | 204/67 |
| 3,471,380 | 10/1969 | Bullough | 204/67 |
| 3,560,448 | 2/1971 | Lodge | 260/78 |
| 4,093,524 | 6/1978 | Payne | 204/61 |
| 4,097,567 | 6/1978 | Cebulak et al. | 264/65 |
| 4,308,114 | 12/1981 | Das et al. | 204/67 |
| 4,308,115 | 12/1981 | Foster et al. | 204/67 |
| 4,333,813 | 6/1982 | Kaplan et al. | 204/243 |
| 4,341,611 | 7/1982 | Kaplan | 204/243 |
| 4,396,482 | 8/1983 | Das et al. | 204/243 |
| 4,411,758 | 10/1983 | Hess et al. | 204/247.4 |
| 4,466,692 | 8/1984 | Sonoda | 339/276 |
| 4,466,995 | 8/1984 | Boxall et al. | 422/113 |
| 4,466,996 | 8/1984 | Boxall et al. | 427/122 |
| 4,526,911 | 7/1985 | Boxall et al. | 523/445 |
| 4,544,469 | 10/1985 | Boxall et al. | 204/243 |
| 4,560,448 | 12/1985 | Sane et al. | 204/67 |
| 4,576,651 | 3/1986 | Deutschman | 134/25.1 |
| 4,624,766 | 11/1986 | Boxall et al. | 204/294 |
| 4,763,585 | 8/1988 | Rickman et al. | 110/346 |
| 4,927,459 | 5/1990 | Gardner et al. | 75/685 |
| 4,973,464 | 11/1990 | Rickman | 423/461 |
| 4,993,323 | 2/1991 | Tabery et al. | 110/346 |
| 5,024,822 | 6/1991 | Hittner et al. | 423/111 |
| 5,028,301 | 7/1991 | Townsend | 204/39 |
| 5,222,448 | 6/1993 | Morgenthaler et al. | 110/346 |
| 5,314,599 | 5/1994 | Allaire | 204/247.4 |
| 5,538,604 | 7/1996 | Keller et al. | 204/247.4 |

FOREIGN PATENT DOCUMENTS

| | | |
|---|---|---|
| 0021850 | 1/1981 | European Pat. Off. . |
| 175159 | 5/1994 | Norway . |

OTHER PUBLICATIONS

Kellner, J.D. et al, "Titanium Diboride Electrodeposited Coatings", Army Materials and Mechanics Research Center, Watertown, Massachusetts 02172, AMMRC TR 77–17, Jun. 1977, pp. 1–2, 31–32.

Sørlie, M. et al, "Cathodes in Aluminium Electrolysis", 2nd Ed., Aluminium–Verlag, 1994, pp. 66–73 and 404–405.

Wendt, H. et al, "Cathodic deposition of refractory intermetallic compounds from Flinak melts. Part II: Preparative cthodic deposition of $TiB_2$ and $ZrB_2$ and coatings thereof", Journal of Applied Electrochemistry 22 (1992), pp. 161–165. (No month).

Wendt, H. et al, "Cathodic deposition of refractory intermetallic compounds from Flinak melts–I. Voltammetric Investigation of Ti, Zr, B, $TiB_2$ and $ZrB_2$", Electrochimica Acta. vol. 37, No. 2, pp. 237–244, 1992. (No month).

*Primary Examiner*—Donald R. Valentine
*Attorney, Agent, or Firm*—Andrew Alexander

[57] ABSTRACT

Disclosed is an improved carbonaceous material suitable for use as a cathode in an aluminum producing electrolytic cell, the cell using an electrolyte comprised of sodium containing compounds. The carbonaceous material is comprised of carbon and a reactive compound capable of suppressing the formation or accumulation of sodium cyanide during operation of the cell, of reacting with sodium to reduce problems associated with sodium intercalation, and of reacting with one of titanium or zirconium to form titanium or zirconium diboride during operation of the cell to produce aluminum.

14 Claims, 1 Drawing Sheet

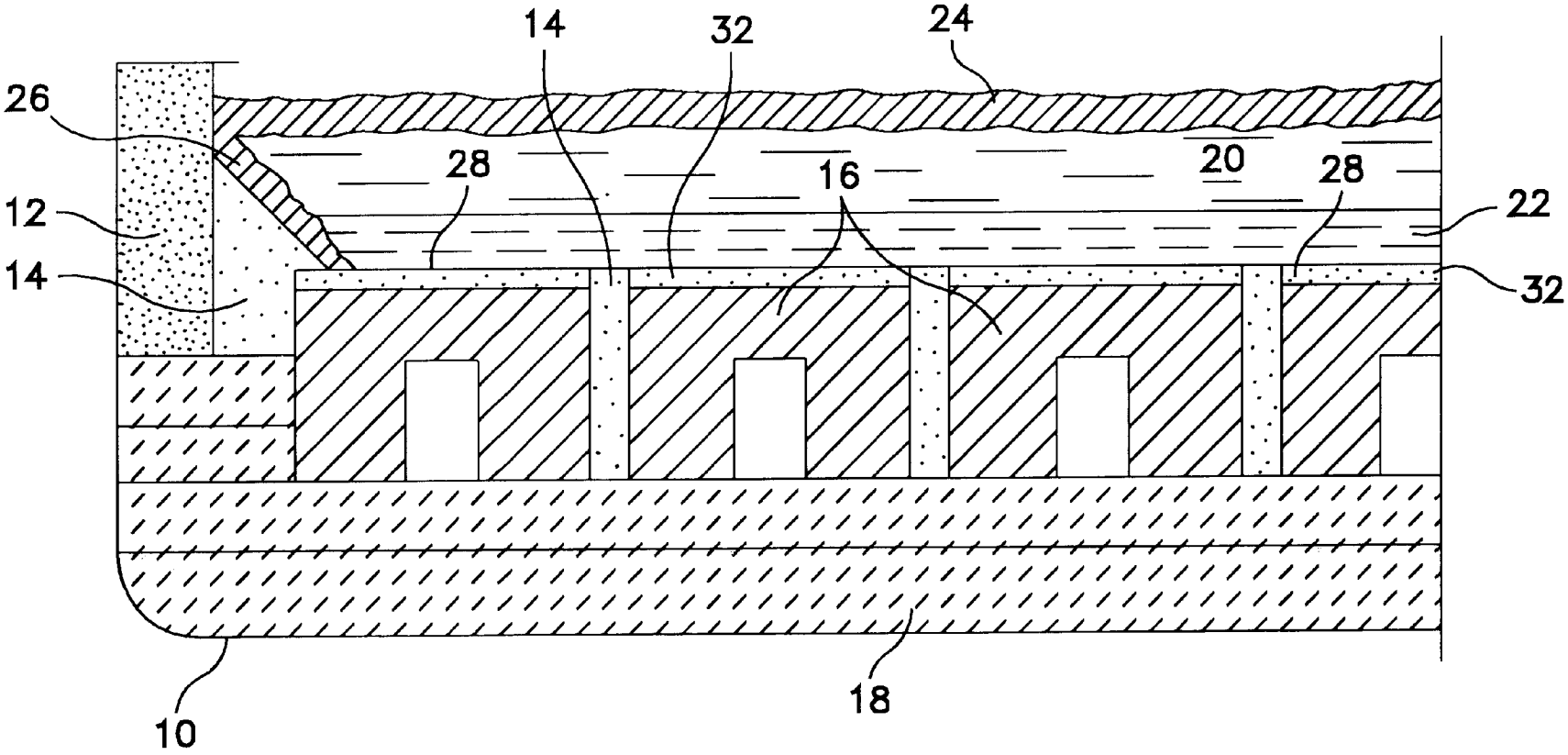
22
32
28
20
24
16
32
14
28
26
12
14
18
10

POTLINING TO ENHANCE CELL PERFORMANCE IN ALUMINUM PRODUCTION

BACKGROUND OF THE INVENTION

This invention relates to production of aluminum, and more particularly it relates to an improved carbon cathode for use in the production of aluminum.

In the Hall-Heroult process for making primary aluminum, aluminum oxide is dissolved in a molten salt such as cryolite and then electrolyzed to form molten aluminum at the cathode. The electrolysis is called out at a temperature in the range of about 930 to 980° C. The molten salt is contained in a steel shell which is lined with refractories and carbonaceous material. The lining containing the cathode metal, located in the bottom of the cell, is usually made of carbon materials. In addition, refractories are used to maintain thermal conditions in the cell. The amount of carbon used is substantial. For example, a Hall-Heroult cell of moderate size uses about 24,000 pounds of carbon block for lining purposes and uses about 10,000 pounds of carbon ramming paste to complete the lining and to hold the carbon blocks in place. The cell has to be relined about every 4 to 6 years, producing large quantities of used carbonaceous material and refractories, i.e., spent potlining.

The use of carbonaceous cathodes is not without problems. For example, they are not readily wettable with molten aluminum. Thus, conductivity through the surface of the cathode is not uniform but tends to be intermittent. Also, the carbon cathode surface reacts with the molten aluminum to form aluminum carbide which depletes the cathode at a rate of 2 to 5 cms per year for an operating electrolytic cell. This depletion is fostered by the presence of sludge containing fluoride bath components at the interface between cathode carbon and metal. The aluminum carbide also is detrimental because it results in a high electrical resistivity material which interferes with the efficiency of the cell.

The carbon cathodes have another problem. That is, sodium and lithium penetrate or intercalate the carbon blocks causing them to swell. In addition, the sodium results in the formation of sodium cyanide causing disposal problems with the spent potlinings. The Environmental Protection Agency has listed spent potlinings as a hazardous material because they contain cyanides. Thus, it will be seen that there is a great need for a carbonaceous cathode that is wettable with molten aluminum, which is resistant to formation of cyanide, and shows a decreased tendency to swell due to sodium intercalation.

In attempts to provide aluminum wettable surfaces on carbon cathodes, application of titanium boride or zirconium boride has been suggested. These materials have been used as tiles to cover the cathode surface and are described in U.S. Pat. Nos. 3,400,061; 4,093,524; 4,333,813; and 4,341,611. However, these approaches have not been without problem. That is, the tiles and coatings tend to fall off after a short period of use, and this interferes with continued use of the cell. Also, coatings of titanium diboride have been applied in cement to the carbonaceous surface in U.S. Pat. Nos. 4,544,469; 4,466,692; 4,466,995; 4,466,996; 4,526,911; 4,544,469 and 4,624,766. EPO 0 021 850 suggests electroplating titanium diboride onto the carbon surface. U.S. Pat. No. 5,028,301 suggests deposition of a coating composed of titanium diboride and titanium carbide on cathode parts from supersaturated dissolved elements in electrowon aluminum. In a book entitled "Cathodes in Aluminum Electrolysis", 2nd edition, published 1994 by Aluminium-Verlag and authored by M. Sørlie and H. A. Øye limited durability and cost of the material are cited as obstacles to effective industrial use.

With respect to disposal of spent carbonaceous material, numerous approaches have been used to convert the cyanide or to render the spent potliner safe for disposal. For example, U.S. Pat. No. 5,222,448 discloses that spent potliner is treated by introducing it into a vessel, and exposing it to the heat of a plasma torch at a temperature of at least 1000° C. As a result, carbon is gasified and converted to combustible carbon monoxide or hydrocarbons, or to carbon dioxide; inorganic material is melted to form slag; fluoride compounds are melted, vaporized, or reduced to gaseous HF; cyanide compounds are destroyed; and all other materials, including sulfur compounds, are either melted or gasified. As a result, the spent potliner is rendered non-hazardous, and the quantity of remaining slag has both its solid volume and mass substantially reduced by a factor of at least 1.5:1 in mass and at least 3:1 in volume relative to the input spent potliner.

U.S. Pat. No. 4,576,651 discloses a process for treating fluoride-contaminated scrap lining material from electrolytic reduction cells which comprises mixing the material with 7–30 pales of sulfuric acid and sufficient water to bring liquid content to 60– 80 pairs per 100 parts of lining material, mixing in sufficient lime to at least neutralize the sulfuric acid and make the slurry slightly alkaline, the slurry then being allowed to set into a solid mass. The slurry should be of a paste-like consistency. The lime may be wholly calcium hydroxide, but a substantial proportion may be in the form of calcium carbonate. The scrap, before or after the above treatment with lime and sulfuric acid, is preferably heated to 150–500° C. in the presence of water vapor to destroy cyanides.

U.S. Pat. No. 4,763,585 discloses a process for the combustion of ground, spent potlinings generated during the production of metallic aluminum. The process includes grinding the potlinings to a particle size of not greater than about 2 inches in any dimension; mixing with the ground potlinings from about 1 to about 20 wt. % based upon the weight of the potlinings, of a powdered inert additive having a median particle size of not greater than 10 micrometers, and burning the ground potlinings in a combustor at a temperature in the range of from 1400° F. to about 2200° F., the additive coating the ground potlinings and preventing their agglomeration in the combustion zone therein.

U.S. Pat. No. 4,973,464 discloses a method for removal of cyanides from spent potlinings from aluminum manufacture. The method discloses the treatment of ground, spent potlinings generated during the production of metallic aluminum to reduce cyanide content to environmentally nonhazardous levels. Potlinings are ground or otherwise suitably reduced in size to a particle size of not greater than about 2 inches in any dimension and roasted in a stream of air or nitrogen at a temperature between about 500° and 1400° F. Roasting for an appropriate time-temperature interval reduces cyanide content to desired levels without combustion of a major portion of carbonaceous material, resulting in an end product rich in carbon and fluorine which may be salable because of this content.

U.S. Pat. No. 4,993,323 discloses that an environmentally acceptable and effective method for thermal destruction of Spent Potliner (SPL) by Fluidized Bed Combustion (FBC) has been established. This method has overcome problems associated with ash agglomeration, ash leachate character and emission control, the primary obstacles for applying FBC to the disposal of SPL and like solid fuels. Specifically, "recipes" of appropriate additives (fuel blends) are proposed. A mixture of lignite, limestone and SPL in an appropriate proportion has proven to notably increase the agglomeration temperature of the ash, allowing this low-melting waste to be destroyed continuously by FBC. Ash leachate character is modified by control of ash chemistry to ensure that fluoride anions and metallic cations are at or below acceptable limits.

U.S. Pat. No. 5,024,822 discloses a process for treating spent potlining from the electrolytic smelting of aluminum in cryolite including incinerating the potlining to combust carbonaceous material to form an ash at a temperature low enough to maintain low fluorine vapor pressures, admixing siliceous material with the potlining either before or after the ash-forming stage, and heating the ash and siliceous material to form a glassy residue.

In Norwegian Disclosure 175, 159, the cyanide-containing potlining is treated is situ by raising the cell temperature before shut-down of the cell, thus promoting penetration of electrolyte into the lining to react with the cyanide.

However, it will be noted that these treatments are post-treatments to correct the hazardous waste problems resulting from spent potlinings, and most of them are relatively expensive. Thus, it will be seen that there is a great need for a method that permits the use of carbonaceous cathodes but is effective in promoting wetting with molten aluminum and is effective in preventing formation of undesirable compounds such as cyanide compounds during use of the cell to produce aluminum. Promoting wetting of the cathode greatly increases the efficiency of the cell and by preventing formation of compounds such as cyanide compounds, any post-treatment for spent cathodes can be greatly simplified.

SUMMARY OF THE INVENTION

It is an object of the invention to provide an improved carbonaceous potlining for an aluminum producing electrolytic cell.

It is another object of the invention to provide an improved carbonaceous potlining for an aluminum producing electrolytic cell having improved molten aluminum wetting characteristics, leading to lower cell resistance, lower tendency to accumulation of sludge and decreased wear of the cathode surface.

Still, it is another object of the invention to provide an improved carbonaceous potlining for an aluminum producing electrolytic cell capable of suppressing formation of cyanide compounds during operation of the cell.

Yet, it is another object of the present invention to provide a novel carbonaceous composition suitable for use as a potliner in aluminum-producing electrolytic cells for improved wetting and reducing sodium and lithium intercalation.

These and other objects will become apparent from reading the specification and claims appended hereto.

In accordance with these objects, there is provided an improved carbonaceous material suitable for use as liner material in an aluminum producing electrolytic cell. The cell uses an electrolyte comprised of sodium containing compounds. The improved carbonaceous material is penetrable by sodium and nitrogen, but it is resistant to formation or accumulation of sodium cyanide during operation of the cell. This improved carbonaceous material also promotes improved molten aluminum wetting properties. The carbonaceous material is comprised of carbon and a reactive compound which is capable of reacting with titanium to produce titanium diboride during operation of the cell to produce aluminum. The reactive compound produces titanium diboride in an amount sufficient to improve molten aluminum wetting properties of the carbonaceous material.

BRIEF DESCRIPTION OF THE DRAWING

The FIGURE is a cross-sectional view of a section of a wall and bottom of a Hall cell used for making aluminum.

DETAILED DESCRIPTION OF PREFERRED EMBODIMENTS

The FIGURE shows a typical construction of a cell bottom 10 with prebaked lining 12 and rammed joints 14. Prefabricated cathode blocks 16 are placed on top of insulating refractories 18. Blocks 16 are traditionally made from rotary kiln or gas calcined anthracite aggregate or electrically calcined anthracite, mixed with a pitch binder. Graphite components can be substituted to increase electrical conductivity. In prefabrication of cathode blocks, green blocks are shaped and pressed, and subsequently baked in special furnaces. Ramming paste 14 is used to fill the spaces and form seams between individual cathode blocks, also to connect the side walls with the carbon blocks. Hot ramming pastes consist of an anthracite filler and a pitch binder. Room temperature paste binder formulations are usually based on a coal-tar or a coal-tar pitch, with a solvent or other additive to lower its softening point and/or increase its coke yield. Also, molasses or additions of solid pitch fines may be included in some formulations. The ramming paste is baked in situ on cell start-up. Ramming paste may be used for the carbonaceous cathodes to form the so-called monolithic cathodes. The sidewalls are usually made from prebaked carbon blocks, ramming paste, or a combination of both. The desired properties of the sidewall are, however, different from those sought for the cathode bottom, and carbon sidewalls are not always the preferred choice.

The cell is shown filled with molten cryolite electrolyte 20. A layer of molten aluminum 22 is shown between electrolyte 20 and cathodes 16. A layer 24 of frozen cryolite is provided covering molten cryolite 20. In addition, frozen cryolite 26 is shown as a layer 12 around the perimeter of the cell above surface 28 of cathodes 16. Anodes are not shown in the FIGURE but normally project through crust or layer 24 into close proximity to surface 28 of cathodes 16.

As noted earlier, the molten aluminum has the problem that it does not readily wet surface 28 of cathodes 16 and reacts with carbon in the cathode to form aluminum carbide. The carbide then dissolves into electrolyte which, with excess alumina, forms a sludge which collects between carbon cathode and metal. The cathode can be consumed at a rate exceeding 2 cm per year for an operating cell. The present invention is designed to improve the wettability of the cathode surface with molten aluminum and inert or minimize reaction of the carbon in the cathode with molten aluminum. Accordingly, there is provided a novel carbonaceous base material containing a reactive compound. The novel carbonaceous base material is suitable for potlinings, cathode blocks, ramming paste and seam mix. The reactive material in the novel carbonaceous base material can be reacted with a source of titanium to form titanium diboride. The reactive compound must be capable of reacting with titanium under the conditions prevailing in the carbonaceous material present in the liner, cathode block, or ramming mix utilized in an aluminum-producing electrolyte cell.

The novel material can comprise 0.1 to 30 wt. % of a compound reactive with titanium in the presence of carbon to produce titanium diboride, the remainder of the novel material comprising carbon. By carbon as used herein is meant to include carbon as used in potlinings, cathode blocks, ramming paste, and seam mix as used in aluminum-producing electrolytic cells.

The novel carbonaceous base material can comprise carbon and 0.1 to 30 wt. % of a reactive compound of a carbide, fluoride, phosphate, or oxide, the compound reactive with titanium in the presence of carbon and aluminum or sodium to form titanium diboride on the surface of the cathode contacted by the molten aluminum in the electrolytic cell. A metal reactive with the reactive compound may be used. The metals, e.g., titanium or zirconium, may be dissolved in the aluminum, possibly as a result of co-deposition, or it may be provided in finely divided or powder form and dispersed with the reactive material in the novel carbonaceous base material. Examples of reactive carbide compounds useful in said novel material include titanium carbide and boron carbide. Reactive fluoride compounds useful in the novel invention include sodium tetrafluoroborate ($NaBF_4$). An example of a reactive phosphate compound useful in said novel invention is boron phosphate ($BPO_4$). Examples of reactive oxide compounds include boron oxide, sodium borate, calcium borate, sodium tetraborate (including borax), boric acid, or an organic derivative of boron oxide compounds, e.g., triethyl boric acid or tripropylborine.

Of the above compounds reactive with titanium or zirconium, the preferred reactive compounds are boron oxide and its derivatives such as boric acid, sodium borate and sodium tetraborate. That is, the boron oxide compounds are preferred because they can combine with titanium to form titanium diboride. Of the boron oxide compounds, boron oxide ($B_2O_3$) is preferred. Also, preferably, the novel material comprises carbon and 0.5 to 5 wt. % reactive compound. A typical amount of reactive compound is in the range of 1 to 2 wt. %. It will be appreciated that combinations of such compounds may be used.

The reactive compound should be capable of reacting with titanium or zirconium to form titanium diboride or zirconium diboride at operating conditions prevalent in the carbonaceous material in the electrolyte cell during operation. Thus, the reactive compound should be capable of reacting with titanium or zirconium in the presence of carbon and aluminum or sodium in a temperature range of 500° to 1000° C.

In the process of using the present invention, a carbonaceous material comprising carbon and the reactive compound are mixed thoroughly and then fabricated into a suitable inner cathode block, ramming mix, or seam mix for use in an aluminum-producing electrolytic cell. That is, the reactive compound is mixed with carbon and/or pitch, depending on the end use, to form a green mix. The green mix is then shaped into cathode blocks or liner. The green cathode blocks are then baked before use, whereby volatile material is driven off. Ramming paste is baked in situ on cell start-up. Then, during operation of the cell, the reactive compound mixed into the carbonaceous mix will operate in its reducing environment to react with a source of titanium or zirconium to form titanium diboride or zirconium diboride at the surface of the carbonaceous cathode contacted by the molten aluminum. The titanium diboride or zirconium diboride are wet by the molten aluminum and are essentially inert. Further, the titanium diboride or zirconium diboride are highly electrically conductive. Thus, the cell operates with greater efficiency and the cathode surface contacted by the molten aluminum has decreased wear or consumption forming aluminum carbide with molten aluminum. That is, the rate of this reaction is minimized and consumption of the cathode is minimized.

While it is important to provide a homogeneous mix of the carbonaceous material and the reactive compound for reasons explained later, a higher concentration layer 32 of the reactive compound can be employed at or penetrating from the surface of the carbon cathode into the body of the cathode. That is, the higher concentration employed at surface of the cathode contacting the molten aluminum makes a higher level of reactive material available to form titanium diboride or zirconium diboride. The reactive material can be applied in different ways to provide high concentrations on or near the surface of the cathode. For example, a powder of the reactive compound can be spread over the surface of the cathode (prior to baking) which will be contacted with the molten aluminum in the cell. Upon baking, the reactive compound becomes imbedded in the cathode surface making it readily available to react with titanium, for example, to form titanium diboride. For example, if boron oxide is the reactive compound, upon baking the green carbon cathode, the boron oxide will melt at about 450° C. and penetrate the surface of the cathode and thereby form a high concentration of boron oxide which is readily available to react with titanium to form a titanium diboride layer which is intimately bonded with or is a part of the carbon cathode. This has the advantage that there is no adhesive bond to fail as in the case of tiles, for example, and yet the titanium diboride provides the aluminum wetting properties which permits efficient operation of the cell.

As the surface wears due to dissolution of titanium diboride into the metal (this process can be decelerated by addition of some boron oxide to the electrolyte), the titanium diboride coating is continuously regenerated.

It will be appreciated that the reactive compound can be made available or applied in any number of ways to the cathode surface. For example, the reactive compound can be applied by spraying. That is, a dispersion can be made and wet sprayed onto the surface of the cathode. Impregnation by the reactive compound may be achieved by placing the reactive compound on the surface, melting it and letting it penetrate into the carbon, as noted.

The titanium or zirconium can be made available for reaction in different ways. For example, titanium metal powder can be mixed with boron oxide powder and applied simultaneously. The titanium can be plasma sprayed onto the cathode surface containing the reactive compound, e.g., boron compound. In another method, titanium metal can be provided in the molten metal to react with the boron compound in the cathode surface layer to form titanium diboride. Or, a titanium compound can be dissolved in the electrolyte and reacted out of the electrolyte at the start-up of the cell and during cell operation. It will be appreciated that a source of titanium can be supplied periodically over the life of the cell to rejuvenate the titanium diboride. Thus, this approach has the advantage of in-situ repairing of defects in the titanium diboride lining layer without shutting down the cell.

As noted above, the reactive material can be homogeneously distributed in the carbonaceous material. Thus, the improved carbonaceous material can provide for an improved wettability of the carbon cathode and at the same time can act to suppress formation or accumulation of cyanide compounds.

Cyanide compounds form in the carbonaceous lining of electrolytic cells during the production of aluminum. Cyanide compounds form in the carbonaceous material from the presence of carbon, sodium and nitrogen at elevated temperatures. The carbon source is the carbonaceous cell lining, i.e., carbonaceous blocks, carbonaceous boards, and carbonaceous based ramming mix and seam paste used. Sodium results from the molten salt electrolyte containing cryolite ($Na_3AlF_6$) used to dissolve alumina ($Al_2O_3$). In the electrolytic reduction of alumina to aluminum and carbon dioxide, some sodium of the electrolyte is reduced at the same time as the alumina. The sodium that is reduced from electrolyte provides free sodium. The sodium migrates or is transferred through or into the carbonaceous lining and ramming paste. The source of nitrogen for the reaction is provided by the air which penetrates into the cathode blocks and into the carbonaceous liner. The reaction that produces undesirable sodium cyanide is as follows:

$$2C+2Na+N_2 \rightarrow 2NaCN$$

Thus, it is important to suppress or stop the formation or accumulation of cyanide compounds such as sodium cyanide in potlinings of aluminum-producing electrolytic cells. Accordingly, there is provided a novel carbonaceous base material and a reactive compound suitable for potlinings, cathode blocks, ramming paste and seam mix which is resistant to formation of cyanide compounds. The reactive compound must be capable of reacting with sodium, nitrogen or sodium cyanide under the conditions prevailing in the carbonaceous material present in the liner, cathode block, or ramming mix utilized in an aluminum-producing electrolyte cell. Thus, the novel material can comprise 0.1 to 30 wt. % of a compound reactive with sodium, nitrogen or sodium cyanide in the presence of carbon to avoid or suppress the formation or accumulation of cyanide compounds, the remainder of the novel material comprising carbon.

The novel carbonaceous base material can comprise carbon and 0.1 to 30 wt. % of a reactive compound of a carbide, fluoride, carbonate, phosphate, or oxide, the compound reactive with sodium, nitrogen or sodium cyanide in the presence of carbon to avoid the formation or accumulation of cyanide compounds. A metal reactive with sodium, nitrogen or sodium cyanide such as aluminum, magnesium, silicon, boron or zinc, may be used. The metals may be provided in finely divided or powder form. Examples of reactive carbide compounds useful in said novel material include silicon carbide, aluminum carbide, titanium carbide and boron carbide. Reactive fluoride compounds useful in the novel invention include aluminum fluoride ($AlF_3$), cryolite ($Na_3AlF_6$), titanium fluoride ($TiF_3$), zirconium fluoride ($ZrF_4$), calcium fluoride ($CaF_2$) and magnesium fluoride ($MgF_2$). Examples of reactive carbonate compounds useful in said novel invention are lithium carbonate ($Li_2CO_3$), calcium carbonate ($CaCO_3$) and barium carbonate ($BaCO_3$). An example of a reactive phosphate compound is boron phosphate ($BPO_4$). Examples of reactive oxide compounds include boron oxide, sodium borate, calcium borate, sodium tetraborate, boric acid, calcium oxide and rare earth oxides.

Of the above compounds reactive with sodium, nitrogen or sodium cyanide, the preferred reactive compounds are boron oxide and its derivatives such as boric acid, sodium borate and sodium tetraborate. That is, the boron oxide compounds are preferred because they can combine with sodium or nitrogen. Further, the boron oxide compounds are preferred because they are reactive with cyanide compounds such as sodium cyanide to convert or decompose it to environmentally benign compounds such as boron nitride and sodium borates. That is, if for some reason, sodium cyanide forms, reactive boron oxide compounds are effective in reacting and converting the cyanide compound to environmentally benign compounds. Of the boron oxide compounds, boron oxide ($B_2O_3$) is preferred. Also, preferably, the novel material comprises carbon and 0.5 to 5 wt. % reactive compound. A typical amount of reactive compound is in the range of 1 to 2 wt. %. It will be appreciated that combinations of such compounds may be used.

The reactive compound should be capable of reacting with sodium, nitrogen or sodium cyanide at operating conditions prevalent in the carbonaceous material in the electrolyte cell during operation. Thus, the reactive compound should be capable of reacting with sodium, nitrogen or sodium cyanide in the presence of carbon in a temperature range of 500 to 1000° C. Further, a reactive compound that is reactive with sodium can also lessen the harmful effect of sodium intercalation into the potlining, thus leading to extended pot life.

In the process of using the present invention, a carbonaceous material comprising carbon and the reactive compound are mixed thoroughly and then fabricated into a suitable liner cathode block, ramming mix, or seam mix for use in an aluminum-producing electrolytic cell. That is, as noted earlier, the reactive compound is mixed with carbon and/or pitch, depending on the end use, to foil a green mix. The green mix is then shaped into cathode blocks or liner. The green cathode blocks are then baked before use, whereby volatile material is driven off. Ramming paste is baked in situ on cell start-up. Then, during operation of the cell, the reactive compound mixed into the carbonaceous mix will operate to scavenge sodium or nitrogen by forming compounds which prevent the formation of cyanide. Sodium cyanide, as it is generated and penetrates the walls or cathode of the cell, will be decomposed by the reactive compound even at places separated from its formation.

In the invention, the amount of the reactive compound dispersed in the carbon material can be varied depending on the potlining and its location in the cell. For example, pockets or layers of the reactive compound can be positioned strategically, if desired. Further, in electrolytic cells that have been in operation, bore holes can be drilled in the potliner or cathode and such holes filled with the reactive compound. When the reactive compound is boron oxide, for example, it has the capability of reacting with the sodium cyanide to form boron nitride and sodium borates according to the following reaction:

$$6NaCN+7B_2O_3 \rightarrow 6C+2N_2+2BN+3Na_2B_4O_7.$$

Thus, it will be appreciated that the electrolytic cell can be operated for a number of years and then treated as noted to decompose sodium cyanide formed in the liner, ramming mix or cathode block to capture free sodium or nitrogen therein.

The following examples illustrate the effectiveness of different reactive compounds in suppressing formation of sodium cyanide carbon potlining material used in electrolytic cells for the production of aluminum and the promotion of wetting by aluminum in the presence of minor amounts of titanium.

EXAMPLE 1

To carbonaceous material used as a commercial ramming mix (Midwest Carbon), composed of sized gas-calcined anthracite coal and about 10% coal-tar pitch, was added aluminum carbide, $Al_4C_3$, to provide a mix containing 3 wt. % $Al_4C_3$. A 47.5 gm sample of the mix containing $Al_4C_3$ was exposed to 2.60 gm of sodium and a nitrogen atmosphere at 600° C. After 3 hours of heating, 646 ml of nitrogen was consumed. The sample was then analyzed and found to contain 1.49 wt. % cyanide (CN). Another sample was treated in the same way except $Al_4C_3$ was not added. The sample without $Al_4C_3$ was found to contain about 2.6 wt. % cyanide (CN). Thus, the addition of $Al_4C_3$ resulted in a decrease of 40% in the amount of cyanide formed.

EXAMPLE 2

Several reactive compounds were tested to determine their effectiveness in suppressing sodium cyanide formation in potlining material. The samples were prepared and tested as in Example 1. The reactive compounds and results are provided in Table 1.

TABLE 1

| Sodium Weight (g) | Reactive Compound (Initial wt. %) | ΔVN2 (ml) | Weight CN (g) | % CN Reduction |
|---|---|---|---|---|
| 2.60 | none | −747 | 1.365 | — |
| 2.60 | 5 wt. % $SiO_2$ | −418 | 0.633 | 53.6 |
| 2.60 | 5 wt. % $Al_4C_3$ | −631 | 0.975 | 28.6 |
| 2.60 | 3 wt. % $B_4C$ | −392 | 0.407 | 70.2 |
| 1.15 | none | −297 | 0.574 | — |
| 1.15 | 8.2 wt. % SiC | −265 | 0.444 | 22.6 |
| 1.15 | 5 wt. % $B_2O_3$ | −15 | 0.013 | 97.7 |
| 1.15 | 20 wt. % $B_2O_3$ | +46 | 0.0004 | 99.9 |

It will be seen from Table 1 that $B_2O_3$ was the most effective reactive compound in suppressing formation of cyanide. That is, the 20 wt. % $B_2O_3$ sample only contained about 9 ppm cyanide in a 45.8 gm sample. It should be noted that these conditions for the test are believed to be more severe than normal aluminum electrolytic cell production conditions, and the test conditions are believed to favor cyanide formation more than cell production conditions would. In the test, sodium was present at unit activity, and its activity in a potlining is about 0.05. Further, in the test, excess quantities of nitrogen were provided and the temperature of the test, 600° C., is believed to be more favorable to cyanide formation than the higher temperatures at which aluminum production cells are operated.

EXAMPLE 3

A carbon sample representing cathode block material was prepared by pressing heated cathode paste (100° to 150° C.), with or without boron oxide additive, and heating the sample for an overnight period at approximately 300° C. The following day, the sample was heated at a 100° C./hr rate to 1000° C. and allowed to soak for one hour before cooling.

Samples were exposed to a two-phase system of molten aluminum metal and cryolite melt contained in a laboratory graphite crucible at a temperature of 1025° C. Two samples, in two different experiments, showed no evidence of wetting by the metal after exposure times of 10 and 30 minutes, respectively.

When a sample containing 5 wt. % $B_2O_3$, as an additive was exposed in the same arrangement to molten aluminum containing 1 wt. % Ti (rather than pure aluminum) for 30 minutes at 1020° C., the sample removed from the system showed that it was wetted by molten aluminum.

It will be seen that the reactive compound provides an improved carbonaceous liner which suppresses formation or accumulation of cyanide compounds in the carbonaceous liner. Also, it will be seen that it reduces the tendency for intercalation of sodium and lithium. Also, it will be seen that an improved cathode is disclosed which provides for improved molten aluminum wettability and thus improved efficiency of the electrolytic cell.

While the invention has been described in teens of preferred embodiments, the claims appended hereto are intended to encompass other embodiments which fall within the spirit of the invention.

What is claimed is:

1. An improved carbonaceous liner material in an aluminum producing electrolytic cell, said cell using an electrolyte comprised of sodium containing compounds, the carbonaceous material resistant to formation or accumulation of sodium cyanide during operation of said cell and having improved molten aluminum wetting properties, the carbonaceous material comprised of:

(a) carbon; and (b) a reactive compound capable of reacting with titanium or zirconium to produce titanium or zirconium diboride during operation of said cell to produce aluminum, said reactive compound present to produce titanium or zirconium diboride in an amount sufficient to improve molten aluminum wetting properties of said carbonaceous material.

2. The carbonaceous material in accordance with claim 1 wherein said reactive compound is present in the range of 0.1 to 30 wt. %.

3. The carbonaceous material in accordance with claim 1 wherein said reactive compound is selected from the group consisting of carbide, fluoride, phosphate and oxide compounds.

4. An improved carbonaceous ramming mix for a monolithic lining and for sealing liner components in an aluminum producing electrolytic cell, said cell using an electrolyte comprised of sodium containing compounds and said carbonaceous mix penetrable by sodium or nitrogen and resistant to formation or accumulation of sodium cyanide during operation of said cell, the carbonaceous ramming mix comprised of:

(a) carbon; and (b) a reactive compound capable of reacting with titanium or zirconium to form titanium or zirconium diboride during operation of said cell to produce aluminum, said titanium or zirconium diboride present in an amount sufficient to improve molten aluminum wetting of said ramming mix.

5. The carbonaceous material in accordance with claim 4 wherein said reactive compound is present in the range of 0.to 30 wt. %.

6. An improved carbonaceous cathode for use in an aluminum producing electrolytic cell, said cell using an electrolyte comprised of sodium containing compounds, said carbonaceous cathode resistant to formation or accumulation of sodium cyanide during operation of said cell, said cathode having improved molten aluminum wetting properties, the carbonaceous cathode comprised of:

(a) carbon; and (b) a reactive compound capable of reacting with titanium or zirconium to provide titanium or zirconium diboride during operation of said cell to produce aluminum, said titanium or zirconium diboride present in an amount sufficient to improve molten aluminum wetting properties of said carbonaceous cathode.

7. The carbonaceous material in accordance with claim 6 wherein said reactive compound is present in the range of 0.1 to 30 wt. %.

8. The carbonaceous material in accordance with claim 6 wherein said reactive compound is boron phosphate.

9. The carbonaceous material in accordance with claim 6 wherein said reactive compound is an oxide compound selected from the group consisting of boron oxide, sodium borate, sodium tetraborate, calcium borate, boric acid, and an organic derivative of boron oxide.

10. The carbonaceous material in accordance with claim 6 wherein said reactive compound is boron oxide.

11. A method of producing aluminum in an electrolytic cell comprising the steps of:

(a) providing an electrolytic cell having an anode;

(b) providing at least one of a liner and a cathode in said cell comprised of a carbonaceous material, wettable by molten aluminum, the carbonaceous material comprised of:

(i) carbon; and (ii) a reactive compound capable of reacting with titanium or zirconium to produce titanium or zirconium diboride during operation of said cell to produce aluminum, said reactive compound present to produce titanium or zirconium diboride in an amount sufficient to improve molten aluminum wetting properties of said carbonaceous material;

(c) dissolving alumina in said electrolyte; and (d) passing an electric current through said cell to produce aluminum at said cathode.

12. The carbonaceous material in accordance with claim 11 wherein said reactive compound is present in the range of 0.1 to 30 wt. %.

13. The carbonaceous material in accordance with claim 11 wherein said reactive compound is an oxide compound selected from the group consisting of boron oxide, sodium borate, aluminum borate, sodium tetraborate, calcium borate, boric acid, and organic derivatives of boron oxide.

14. The carbonaceous material in accordance with claim 11 wherein said reactive compound is boron oxide.

* * * * *